US005473869A

United States Patent [19]

Chikatani

[11] Patent Number: 5,473,869

[45] Date of Patent: Dec. 12, 1995

[54] BAGGING APPARATUS

[75] Inventor: Hajime Chikatani, Hachioji, Japan

[73] Assignee: Daisey Kikai Co., Ltd., Tokyo, Japan

[21] Appl. No.: 216,419

[22] Filed: Mar. 23, 1994

[30] Foreign Application Priority Data

Mar. 26, 1993 [JP] Japan ..... 5-105851

[51] Int. Cl.[6] ..... B65B 5/06; B65B 39/02; B65B 39/12; B65B 1/24

[52] U.S. Cl. ..... 53/570; 53/529; 53/258; 53/260

[58] Field of Search ..... 53/134.1, 134.2, 53/137.2, 138.6, 139.4, 571, 573, 570, 258, 260

[56] References Cited

U.S. PATENT DOCUMENTS

| | | | |
|---|---|---|---|
| 3,330,093 | 7/1967 | Schorer | 53/572 |
| 3,390,352 | 1/1976 | Carnes | 53/572 |
| 4,047,362 | 9/1977 | Lister et al. | 53/572 |
| 4,377,926 | 3/1983 | Altenpohl et al. | 53/572 |
| 4,671,048 | 6/1987 | Rademacher | 53/572 |
| 5,022,216 | 6/1991 | Muckenfuhs et al. | 53/260 X |
| 5,228,275 | 7/1993 | Formo | 53/572 |

*Primary Examiner*—Horace M. Culver
*Attorney, Agent, or Firm*—Oblon, Spivak, McClelland, Maier & Neustadt

[57] ABSTRACT

The article-to-be-bagged feeding device for feeding an article to be bagged into an opened bag, adopted in the bagging apparatus according to the present invention, has two gripping members disposed in parallel which are reciprocated in the direction of feeding the article to be bagged. The feeding device has a gripping member operator for guiding the two gripping members, in such a manner that the mutual interval between the gripping members is narrowed, thereby causing them to grip the article to be bagged when they advance towards the bag, and further the mutual interval of the gripping members is widened when they retreat from the bag, and the mutual interval thereof is slightly widened when they are transferred from forward movement to rearward movement. Namely, The gripping members grip the article to be bagged due to their mutual interval narrowed when advancing, and feed it into the bag, and they are then caused to retreat, leaving the article in the bag due to the mutual interval therebetween being slightly widened.

6 Claims, 5 Drawing Sheets

BAGGING APPARATUS

BACKGROUND OF THE INVENTION

1. Technical Field

The present invention relates to a bagging apparatus for feeding an article to be bagged into a bag opened by a bag opening means, thereby bagging the article.

2. Description of the Prior Art

A bagging apparatus constructed such that an article to be bagged is fed into a bag opened by a bag opening means, has been already proposed.

For instance, the apparatus which applicant proposed (Japanese Patent Application No. 130,836/1991) is shown in FIG. 10. In this apparatus, a plastic bag conveyed is opened by a suction opening means 15 as disclosed, for instance, in Japanese Patent Publication No. 39,929/1989. Then, a bellows plate 23 is caused to pass into the plastic bag opened, and it inflates the bag in the form of a streamer. By putting a chuck 30 into the plastic bag, the bag is held expanded to the maximum degree by the chuck 30.

Into the plastic bag whose opening has been expanded as mentioned above, an article to be bagged is fed by a pushing means 33 which moves attached on a chain 32. However, this apparatus of the prior art is somewhat complicated in structure and lacks durability because it has a plurality of the pushing means 33 attached on the chain 32.

SUMMARY OF THE INVENTION

It is an object of the present invention to provide a bagging apparatus having an article-to-be-bagged feeding device, which is simple in structure and durable, for feeding an article to be bagged into a bag opened by a bag opening means.

In order to solve the aforementioned problems, the bagging apparatus according to the present invention has an article-to-be-bagged feeding device comprising: two gripping members disposed in parallel, which are reciprocated in the direction of feeding the article to be bagged: and a gripping member operating means for guiding the two gripping members which are reciprocated, in such a manner that the interval between the gripping members is narrowed, thereby causing the gripping members to grip the article to be bagged when they advance, and the interval between the gripping members is widened when they are withdrawn from the bag wherein the interval therebetween is slightly widened when they are transferred from forward movement to rearward movement.

In the bagging apparatus according to the present invention which has the article-to-be-bagged feeding device constructed as mentioned above, the gripping members whose mutual interval has been narrowed by the gripping member operating means constituing the article-to-be-bagged feeding device grip the article to be bagged, and feed the gripped article into a bag opened by a bag opening means by virtue of their foreward movement. Since the interval between the gripping members is slightly widened by the gripping member operating means when they start to withdraw from the bag, the gripped article is released in the bag and only the gripping members are permitted to retreat therefrom.

In the bagging apparatus according to the present invention, a drive unit for the gripping members serves only to cause a reciprocation of the gripping members, and both the gripping action of gripping the article to be bagged by the gripping members and the releasing action for releasing the gripped article are generated by the gripping member operating means for guiding the gripping members, which are reciprocated, in the lateral direction. The respective means are simple in operation and simple in construction.

In one preferred embodiment of the bagging apparatus according to the present invention, there may be such a construction that the gripping members are held on a machine frame slidably in the lateral direction by a sliding holding means equipped with an engagement pin, and a gripping member guide is provided which has a guide groove for guiding said engagement pin, whereby said gripping member guide is made variable in the positions of both its ends. Owing to the aforementioned construction, a mechanism can be easily realized which causes a lateral displacement to the gripping members which are reciprotated.

In order to vary both the end positions of said gripping member guide, air cylinders are connected to both of these ends.

In the gripping members in the bagging apparatus according to the present invention, an engagement piece is preferably provided which is made projectable for engaging with the article to be bagged which has been gripped by the gripping members, thereby ensuring feeding operation of the same article.

Moreover, the bagging apparatus according to the present invention can be made compact and simple by providing a construction such that said gripping members and said gripping member operating means are disposed one over the other.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

The apparatus according to one preferred embodiment of the present invention will now be described.

Figure 1:
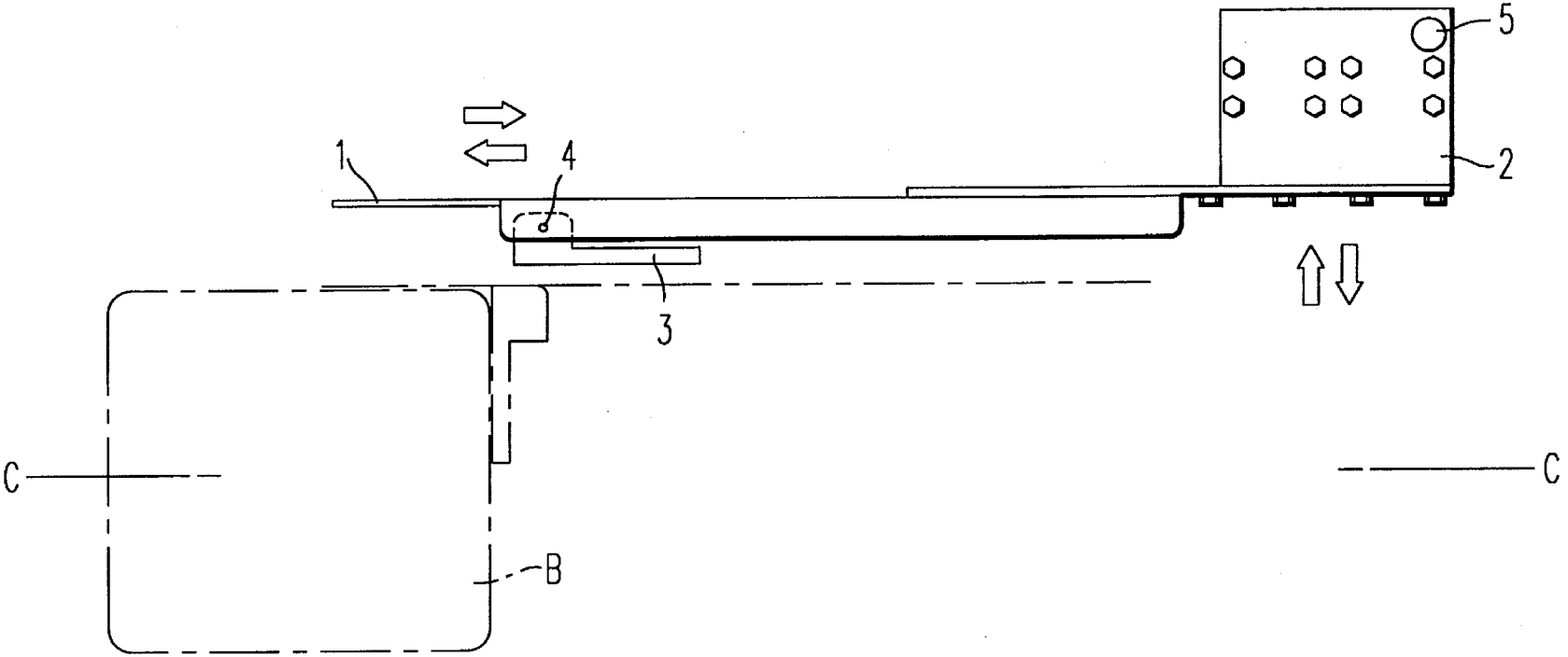
FIG. 1 is a plan view showing only half of one preferred embodiment of the gripping member used in the bagging apparatus according to the present invention.
Figure 10:
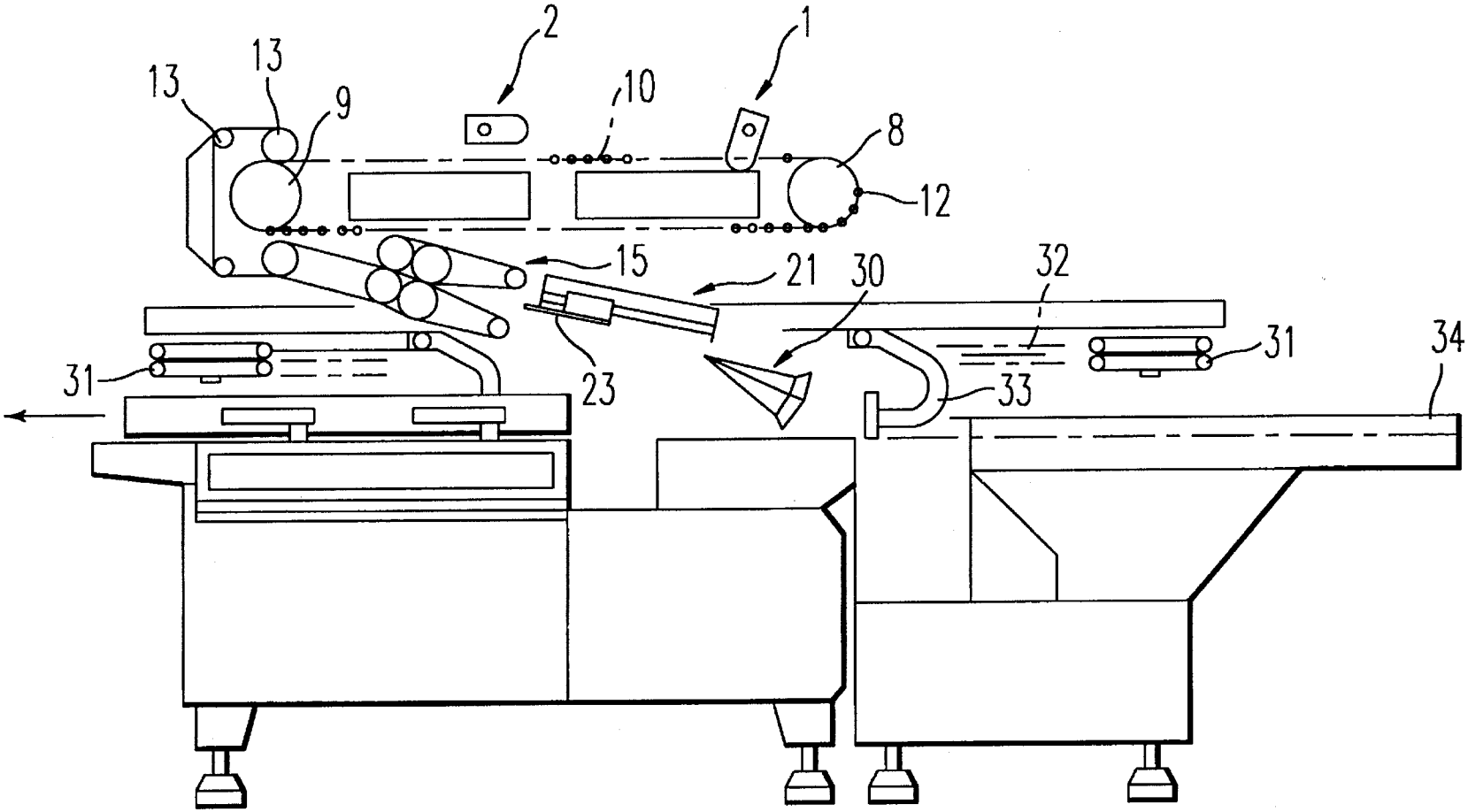
FIG. 10 is a front view showing an example of the bagging apparatus of the prior art.

In the plan view of FIG. 1, there is shown only one gripping member 1, for simplification of the drawing. In fact, however, another one is also disposed in parallel therewith symmetrically with respect to a center line C—C in the drawing. The two gripping members 1 disposed in parallel as mentioned above serve to grip at a predetermined position an article which is being conveyed between the gripping members 1 by means of conveyors (designated by A in FIG. 2) travelling in the direction of the center line C—C, and to feed the article into a packaging bag opened as described in FIG. 10. Each gripping member 1 is held on a machine frame and is slidable in the directions of the white arrows by means of a sliding holding means 2.

The gripping member 1 is reciprocated in the directions shown by black arrows in the drawing by proper means such as an air cylinder or a reciprocating rotary motor. The gripping member 1 has an engagement piece 3 pivotally secured thereon by a pin 4, and said engagement piece 3 will be set by means of an air cylinder or the like as vertically projected with respect to the gripping member 1 as shown by an imaginary line in the drawing. The sliding holding means 2 has an engagement pin 5 attached thereon as erected on the plane of the drawing. When the gripping members 1 are displaced downward of FIG. 1 as shown by the imaginary line by means of a gripping member operating means which will be hereinafter described because they are held slidably in the directions of the white arrows as mentioned above, the gripping members 1 will grip an article B to be bagged by their fore end portions. At that time, the engagement pieces 3 will be projectedly raised, thereby supporting the rear portion of the article B as shown in phantom lines in FIG. 1.

Over the gripping member 1, on the other hand, spacedly from the gripping member 1 which is reciprocated in the directions of the black arrows, a support plate 6 is fixed on the machine frame, said support plate 6 having the gripping member operating means for controlling the displacement of the gripping member 1 in the directions of the white arrows. The support plate 6 has a first air cylinder 7 pivotally secured thereon by a pin 8 and a second air cylinder 9 also pivotally secured thereon by a pin 10. To the piston rod of the first air cylinder 7 is pin-fixed one end of a first link 11, and the first link 11 is pivotally secured on the support plate 6 by a pin 12. In addition, to the piston rod of the second air cylinder 9 is pin-fixed one end of a second link 13 pivotally secured on the support plate 6 by a pin 14.

On one end of the first link 11 is formed an engagement groove 15. Reference numeral 16 designates a gripping member guide having a guide groove 17 formed in the longitudinal direction, in which one end thereof is held in the engagement groove 15 of the first link 11 through the intermediary of a pin 18 and the other end thereof is pivotally secured on the second link 13 by a pin 19. In the guide groove 17 of the gripping member guide 16 is inserted the engagement pin 5 which is mounted on the sliding holding means 2 attached to the gripping member 1.

Figure 2:
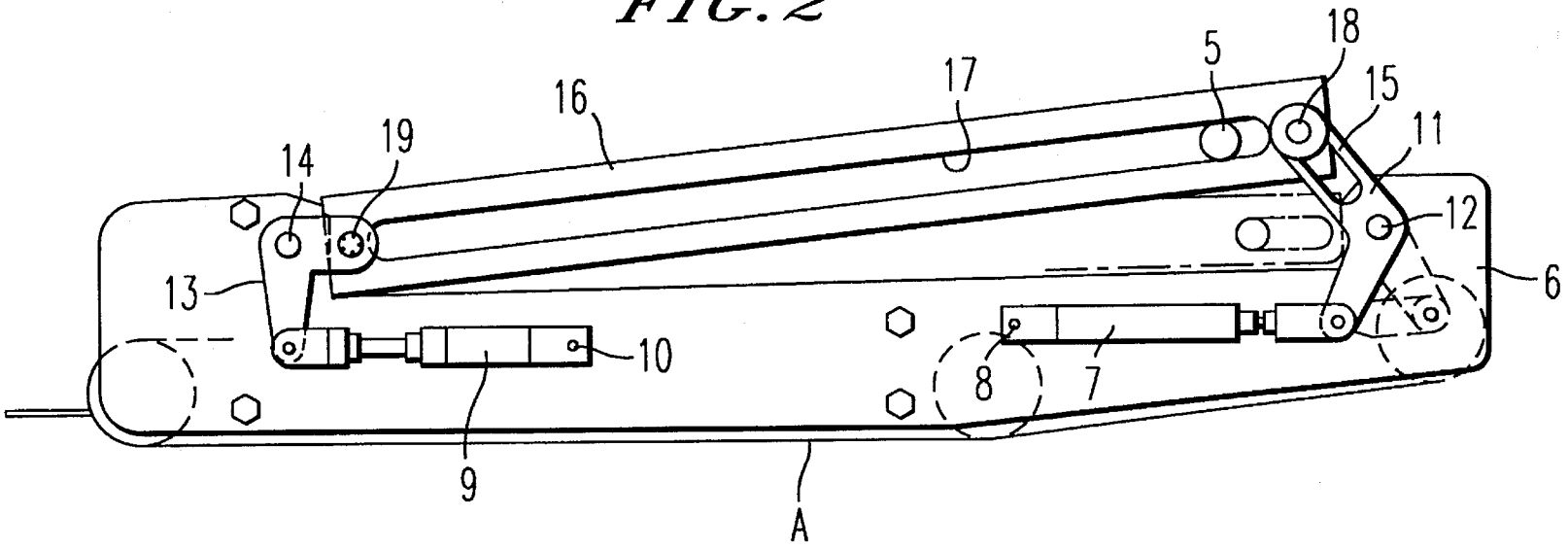
FIG. 2 is a plan view showing only a half of one preferred embodiment of the gripping member operating means used in the bagging apparatus according to the present invention.

When the first air cylinder 7 is therefore expanded, the first link 11 will be turned counterclockwise as shown by an imaginary line in FIG. 2 and the gripping member guide 16 will be turned clockwise round the pin 19 as a center. Thus, the engagement pin 5 engaging with the guide groove 17 of the gripping member guide 16 will be displaced downward. As a result, the gripping member 1 illustrated in FIG. 1 will be displaced to the imaginary line position of FIG. 1.

When the second air cylinder 9 is then contracted, the gripping member guide 16 will be turned clockwise round the pin 18 as a center, thereby causing the engagement pin 5 to move upward. Namely, the engagement pin 5 is displaced upward over the position shown by the imaginary line of FIG. 1. In addition, the stroke of the second air cylinder 9 is smaller than that of the first air cylinder 7 and therefore, the displacement which will be given to the gripping member guide 16 by the second air cylinder 9 is smaller than that given thereto by the first air cylinder 7.

Owing to the aforementioned construction, the first air cylinder 7, first link 11 and pin 18 serve to guide the two gripping members 1 disposed in parallel which are reciprocated, in such a manner that the interval between them is narrowed or widened, while the second air cylinder 9 and second link 13 serve to guide the two gripping members 1 when transferred from a forward movement to a rearward movement in such a manner that the interval between them is somewhat widened. Theses parts constitute the gripping member operating means in the apparatus according to the present invention.

In the next place, the operation of the apparatus described above will be explained referring to FIGS. 3 to 9.

Figure 3:
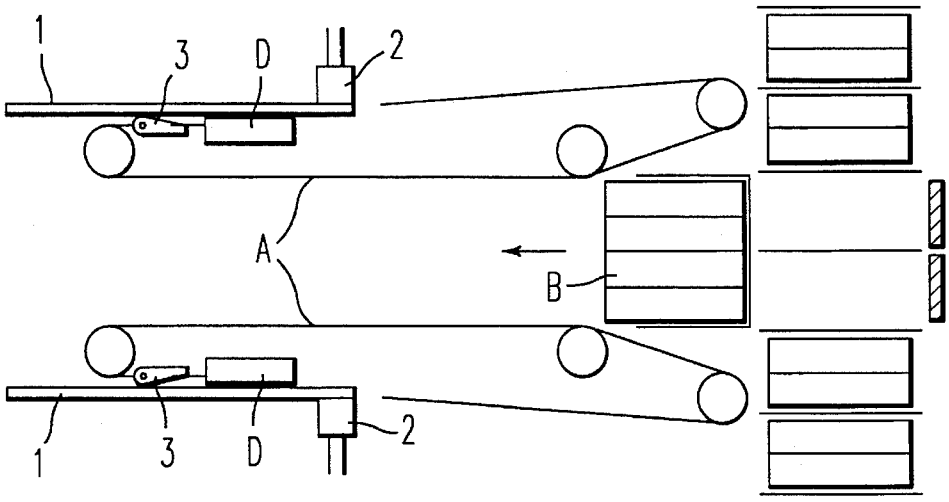
FIG. 3 is a plan view showing the operation of the bagging apparatus according to the present invention, depicting a situation wherein an article to be gripped is fed.
Figure 4:
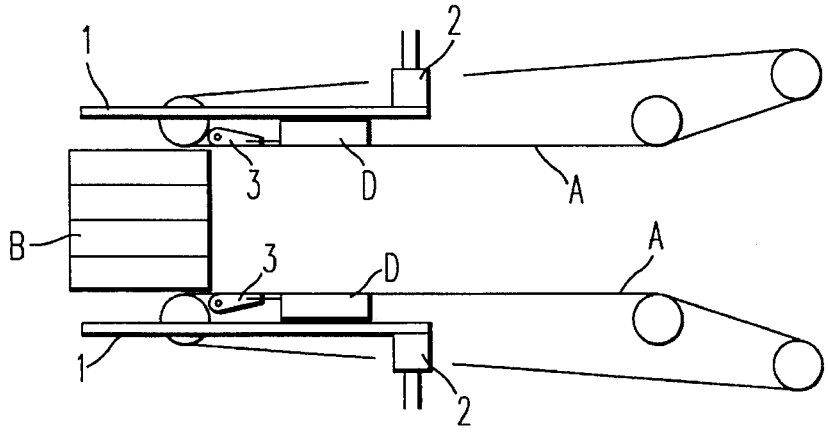
FIG. 4 is a plan view similar to FIG. 3 depicting a situation wherein the gripping members are about to grip the article.
Figure 5:
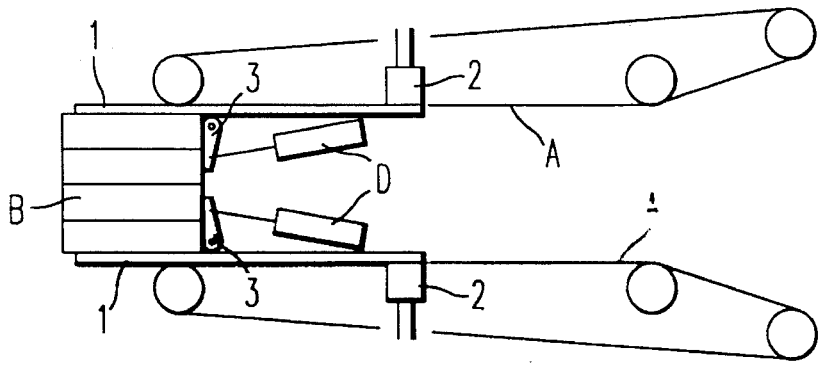
FIG. 5 is a plan view similar to FIG. 3 depicting a situation wherein the gripping members have gripped the article.

An article B to be bagged is being conveyed to the rear position of the two gripping members 1 disposed in parallel (see FIG. 3). Then, article B is fed to the fore end portions of the gripping members 1 as held by the conveyors A disposed in parallel. At that time, the interval between the gripping members 1 is narrowed by means of the gripping member operating means shown in FIG. 2 (see FIG. 4). The gripping members 1, whose mutual interval has been narrowed, grip the article B from both the sides, and at that time, their engagement pieces 3 are projected vertically with respect to the gripping members 1 by means of the air cylinder D so as to support the rear portion of the article B (see: FIG. 5).

Figure 6:
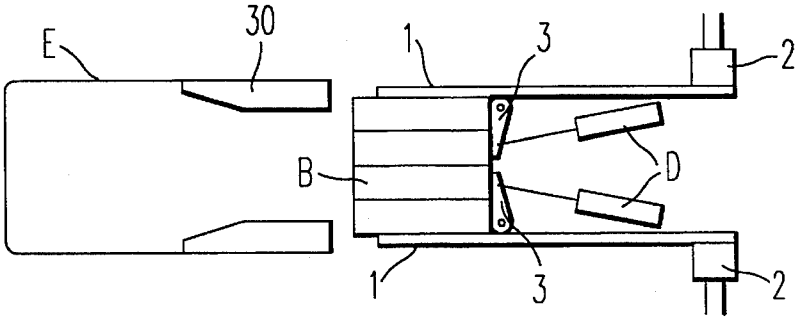
FIG. 6 is a plan view similar to FIG. 3 depicting a situation wherein the gripping members are about to put the article into the bag.
Figure 7:
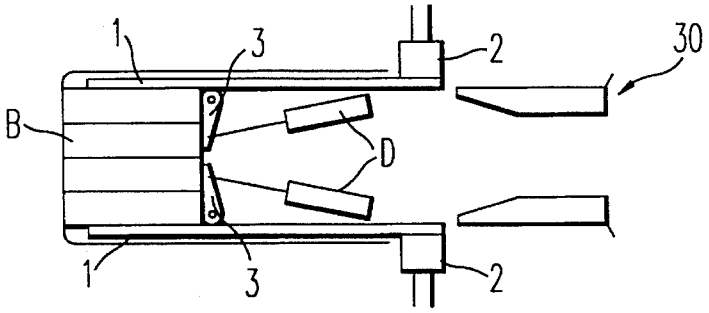
FIG. 7 is a plan view similar to FIG. 3 depicting a situation wherein the gripping members have put the article in the bag.
Figure 8:
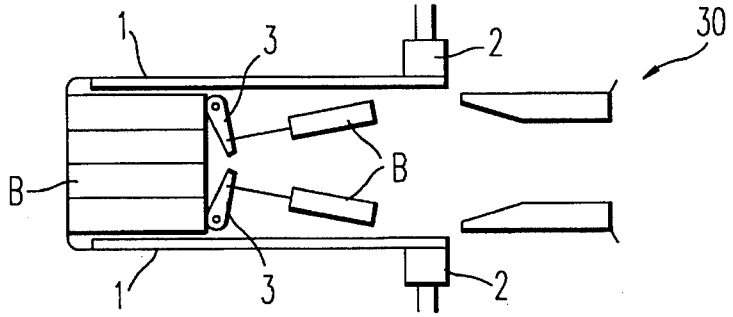
FIG. 8 is a plan view similar to FIG. 3 depicting a situation wherein the gripping members have released the article in the bag.

Then, the gripping members 1 which have gripped the article B are continuously displaced forward so as to pass to the opening of a bag E whose opening has been expanded by a chuck 30 (see: FIG. 6), and they shifted into the bag E while gripping the article B (see: FIG. 7). The interval between the gripping members 1 is slightly widened by the action of the second air cylinder 9 constituting the gripping member operating means described in FIG. 2, thereby releasing the gripping of the article B in the bag E, and the engagement pieces 3 will be returned from the projecting position to the original position (see FIG. 8).

Figure 9:
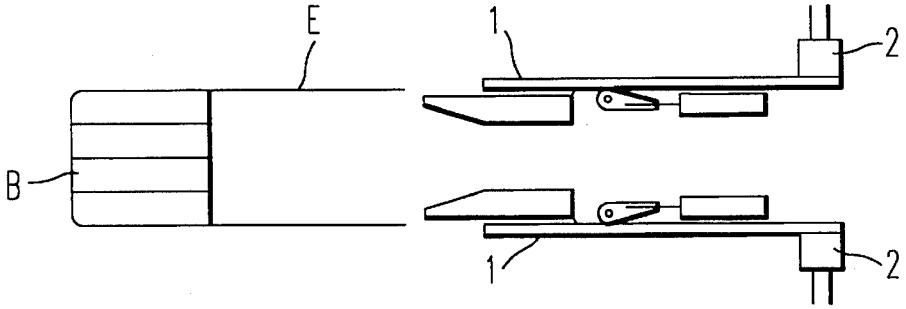
FIG. 9 is a plan view similar to FIG. 3 depicting a situation wherein the gripping members have been withdrawn from the inside of the bag.

After that, the gripping members 1 are caused to withdraw from the inside of the bag E so that the article B is left in the bag E (see FIG. 9). The bag E in which the article B has be put as mentioned above by means of the article-to-be-bagged feeding device will be properly closed in its opening. Thus, the bagging operation is completed.

In the bagging apparatus according to the present invention, there is adopted the gripping member operating means having the first air cylinder 7 and the gripping member guide 16 as a mechanism for guiding two gripping members 1 disposed parallel in such a manner that the interval between the gripping members 1 is narrowed, thereby causing them to grip an article to be bagged when they advance, and the interval therebetween is widened when they retreat, and further having the second air cylinder 9 and the second link 13 as a mechanism for guiding the gripping members 1 in such a manner that the interval between the gripping members is slightly widened when they are transferred from forward movement to rearward movement.

If another structure is one which can give a displacement in the directions of white arrows to the gripping members 1 which are reciprocated as shown by black arrows in FIG. 1, as the gripping member operating means, however, there may be properly selected, for instance, a structure wherein the gripping members 1 which are reciprocated are guided along a stationary cam groove, thereby causing the gripping members to make such action as mentioned above. As to the means for slightly widening the interval between the gripping members 1, another structure can be similarly selected.

As has been described above, the bagging apparatus according to the present invention is simple in structure and can carry out the bagging operation reliably because it makes use of the article-to-be-bagged feeding device which causes the reciprocated gripping members to grip an article to be bagged so as to feed the article into an opened bag, to release the article in the bag, and to retreat, with leaving the same article in the bag.

What is claimed is:

1. A bagging apparatus which feeds an article to be bagged into an opened bag, which comprises:

a feeding device which includes two gripping members disposed in parallel, which are reciprocable in a direction of feeding of the article to be bagged; and a gripping member operator guiding and reciprocating the two gripping members in such a manner that an interval between the gripping members is narrowed, thereby causing the gripping members to grip the article to be bagged and to then advance towards and into the bag, said gripping members releasing the article while the gripping members are inside the bag and withdrawing from the bag when the interval between the gripping members is widened wherein at least one of said gripping members includes an engagement piece secured therein for supporting a rear portion of the article when the gripping members are advanced towards and into the bag.

2. A bagging apparatus as claimed in claim 1 wherein said gripping members and said gripping member operator are disposed adjacent one another.

3. The bagging apparatus of claim 1 wherein said engagement piece is pivotally scanned to said at least one of said gripping numbers.

4. A bagging apparatus which feeds an article to be bagged into an open bag, which comprises:

a feeding device which includes two gripping members disposed in parallel, which are reciprocable in a direction of feeding of the article to be bagged, and a gripping member operator guiding and reciprocating the two gripping members in such a manner that an interval between the gripping members is narrowed, thereby causing the gripping members to grip the article to be bagged and to advance toward the bag when the gripping members are moved towards one another, said gripping members releasing the article and withdrawing from the bag when the interval between the gripping members is widened; and a sliding and holding mechanism which holds the gripping member in a lateral direction thereof, said sliding and holding mechanism including an engagement pin and a gripping member guide having a guide groove formed therein guiding said engagement pin, and first and second mechanisms on said gripping member guide which vary positioning of opposite ends of the gripping member guide.

5. A bagging apparatus as claimed in claim 4, wherein the first and second mechanisms each comprise a link connected to an end portion of said gripping member guide, and an air cylinder connected to said link.

6. A bagging apparatus which feeds an article to be bagged into an open bag, which comprises:

a feeding device which includes two gripping members disposed in parallel, which are reciprocable in a direction of feeding of the article to be bagged, and a gripping member operator guiding and reciprocating the two gripping members in such a manner that an interval between the gripping members is narrowed, thereby causing the gripping members to grip the article to be bagged and to advance toward the bag when the gripping members are moved towards one another, said gripping members releasing the article and withdrawing from the bag when the interval between the gripping members is widened; and an engagement pin pivotally secured on each of said gripping members so as to be projectable and to engage with the article to be bagged which has been gripped by the gripping members.

* * * * *